US005266009A

United States Patent [19]

Tasaki et al.

[11] Patent Number: 5,266,009

[45] Date of Patent: Nov. 30, 1993

[54] IMPELLER STRUCTURE FOR WATER JET PROPELLED BOAT

[75] Inventors: Hiroshi Tasaki; Yasuhiko Henmi, both of Hamamatsu, Japan

[73] Assignee: Sanshin Kogyo Kabushiki Kaisha, Japan

[21] Appl. No.: 883,270

[22] Filed: May 14, 1992

[30] Foreign Application Priority Data

May 20, 1991 [JP] Japan ..... 3-144030

[51] Int. Cl.[5] ..... B63H 11/08

[52] U.S. Cl. ..... 416/223 R; 416/244 B; 416/245 A; 415/218.1; 415/221; 415/222; 440/38

[58] Field of Search ..... 415/218.1, 219.1, 220, 415/221, 222; 416/223 R, 234, 244 B, 245 A; 440/38, 49; 114/270

[56] References Cited

U.S. PATENT DOCUMENTS 2,936,948 5/1960 Eck ..... 415/218.1
3,164,122 1/1965 Fageol .
4,971,584 11/1990 Inoue et al. ..... 440/38

FOREIGN PATENT DOCUMENTS 0051299 3/1983 Japan ..... 416/245 A
1144938 3/1985 U.S.S.R. ..... 440/38

*Primary Examiner*—Edward K. Look
*Assistant Examiner*—Christopher M. Verdier
*Attorney, Agent, or Firm*—Bacon & Thomas

[57] ABSTRACT

A water jet propelled boat is equipped with a water intake opening, a water jet outlet, and with a mixed flow type impeller, where the above mentioned water intake opening and the above mentioned water jet outlet are connected by a water passage with the impeller in the middle of the water passage, and where the operation of the impeller causes water to be drawn into the water intake opening and expelled through the above mentioned water outlet to propel the boat. The impeller structure is such that a boss section of the impeller has a plurality fins affixed to it, the outside edges of the above mentioned spiral fins are roughly parallel to the axial center of the above mentioned boss, and, the leading and the trailing edges of the fins, with respect to the axial center of the above described boss, slant down toward the above mentioned water outlet opening. At the same time relative speeds, the invention allows a smaller diameter fin unit and, at speeds of 4,000 rpm and over, it offers improved efficiency.

5 Claims, 5 Drawing Sheets

Bar 1: Prior art example 1 (axial flow Ns=1500)
Bar 2: Prior art example 2 (slanted flow Ns=1300)
Bar 3: Prior art example 3 (Ns=1450)
Bar 4: This invention

IMPELLER STRUCTURE FOR WATER JET PROPELLED BOAT

BACKGROUND OF THE INVENTION

1. Field of the Invention

This invention concerns a mixed flow type of impeller structure for use in a water jet propelled boat.

2. Description of Related Art

Conventionally, water jet propelled boats are equipped with water intake openings and water outlets connected by a water passage which has either a mixed flow type or an axial flow type impeller positioned in the middle of the water passage. The action of the impeller draws water into the water intake opening and expels it through the water jet outlet in order to propel the craft, as described for example in Japanese Utility Patent Application Publication Sho 54-136296.

SUMMARY OF THE INVENTION

An objective of this invention is to provide a mixed flow impeller structure with a fin area that is more compact than prior art impeller structures and which provides improved characteristics when operated at the same relative speed.

The inventive impeller structure is designed for use in a water jet propelled boat of the type which includes a water intake opening and a water jet outlet together with a mixed flow type impeller. The water intake opening and the water jet outlet are connected by a water passage with the impeller in the middle of the water passage. Operation of the impeller causes water to be drawn into the water intake opening and to be expelled through the water outlet to propel the boat.

A boss section of the inventive impeller structure has a plurality fins affixed to it. The outside edges of the fins are roughly parallel to the axial center of the boss, and both the leading and the trailing edges of the fins slant, from the outside edge inward, towards the water outlet opening, i.e., towards the downstream side of the impeller.

As a result of the inventive impeller structure, it is possible to make the diameter of the fins smaller than those of the prior art, while nevertheless improving efficiency relative to conventional impeller structures operated at the same relative speed.

BRIEF DESCRIPTION OF THE DRAWINGS

FIG. 6(*b*) is a diagram illustrating a prior art impeller shape.

FIG. 6(*c*) is a diagram illustrating a prior art impeller shape.

DETAILED DESCRIPTION OF THE PREFERRED EMBODIMENT

Figure 1:
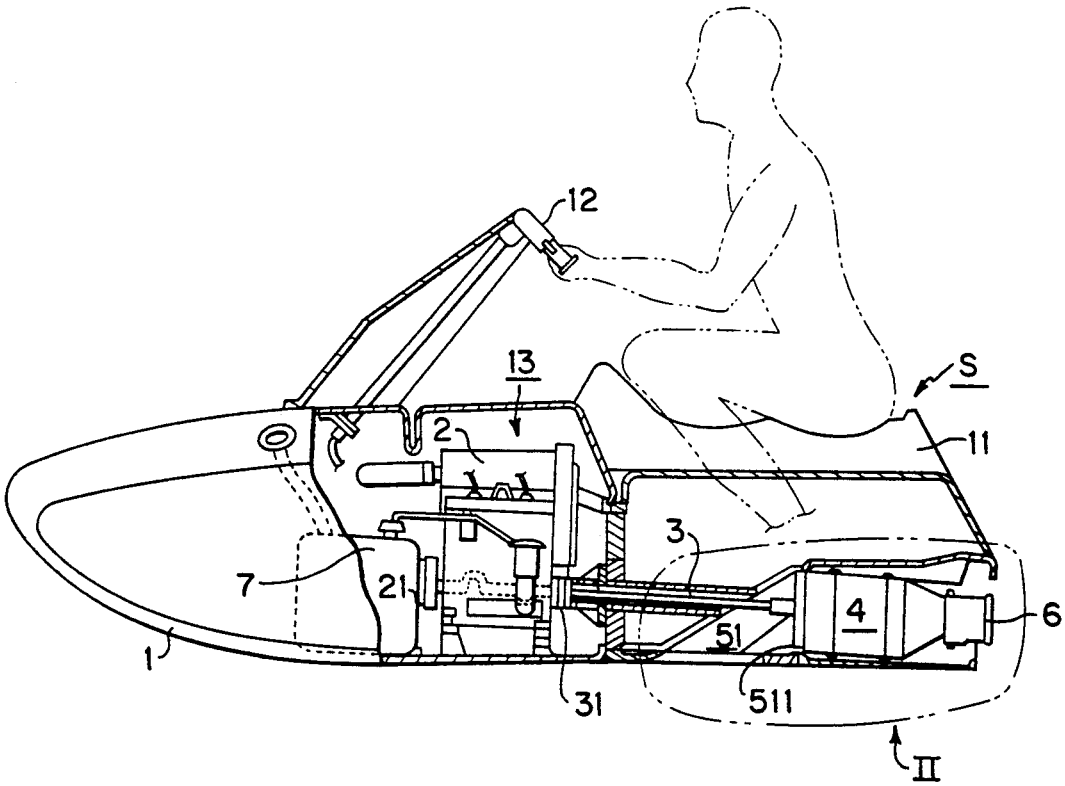
FIG. 1 is a cross-sectional side view of a water jet propelled boat constructed in accordance with the principles of a preferred embodiment of the invention.

As shown in FIG. 1, water jet propelled boat S includes a hull, a seat 11, a steering handle 12, an engine compartment 13, and an engine 2 which is mounted inside the engine compartment 13. Engine 2 includes a crankshaft 21, and an output shaft 3 which is joined to crankshaft 21 by means of coupling 31. Output shaft 3 extends to the propulsion unit 4 which will be described below.

A water intake duct or water passage 51 is positioned rearward of the engine compartment 13 of boat 1. The upstream end of water intake duct 51 forms the water intake opening in the bottom of the boat and connects to propulsion unit 4. A steering nozzle 6 is mounted in the rear of the propulsion unit 4 so that it may swing left and right. Steering nozzle 6 responds to the operation of the above-mentioned steering handle 12. Finally, a fuel tank 7 is also mounted inside the boat.

Figure 2:
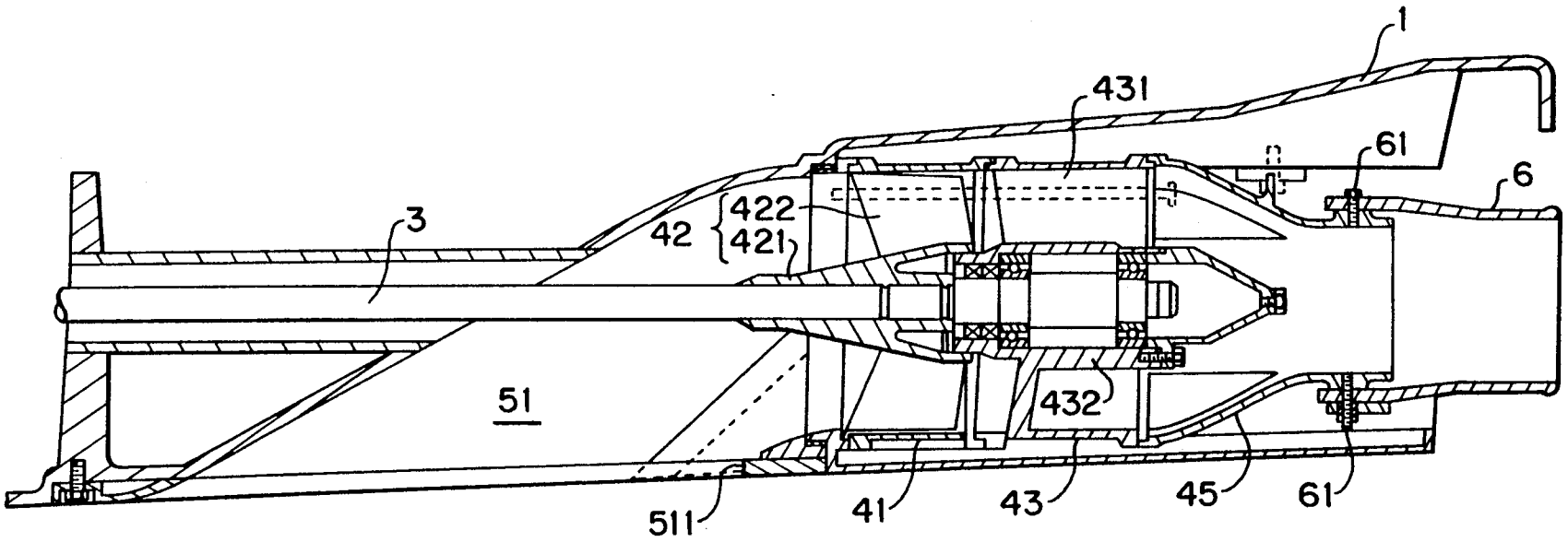
FIG. 2 is an enlarged cross-sectional view of area II in FIG. 1.

Next, the propulsion unit 4 will be described in detail with reference to FIG. 2:

As shown in FIG. 2, an impeller casing 41 is connected to the downstream end of water intake duct 51. An impeller 42, which will be described below, is housed inside impeller casing 41. A stationary wing casing 43 connects to the downstream end of impeller casing 41. This stationary wing casing 43 contains stationary wing 431. Also, a nozzle or water jet outlet 45 is connected to the downstream end of stationary wing casing 43. Water under pressure is expelled rearward from nozzle 45. Bolts 61 support the nozzle 45 so that it can be swung left and right.

Bearings 432 are formed integrally along the axial center of static wing casing 43 and support the rear end of output shaft 3. Also, a boss unit 421 is affixed to output shaft 3 inside the impeller casing 41. Boss unit 421 has a frusto-conical shape with the small diameter end facing upstream, and rotates in conjunction with output shaft 3. A fin unit 422 is affixed to boss unit 421 and extends in a radial configuration.

In accordance with the principles of a preferred embodiment of the invention, outer edges 423 of the fins are roughly parallel to the axial center 426 of boss 421. In addition, the fins of fin unit 422 have non-parallel leading edges 424 and trailing edges 425 which, starting from the outside edge 423, slant towards the downstream side of the impeller, represented by arrow A in FIG. 3, and towards the axial center 426 of boss unit 421. Boss unit 421 includes an outer surface 427, a trailing surface 428, and a leading surface 429.

Figure 3:
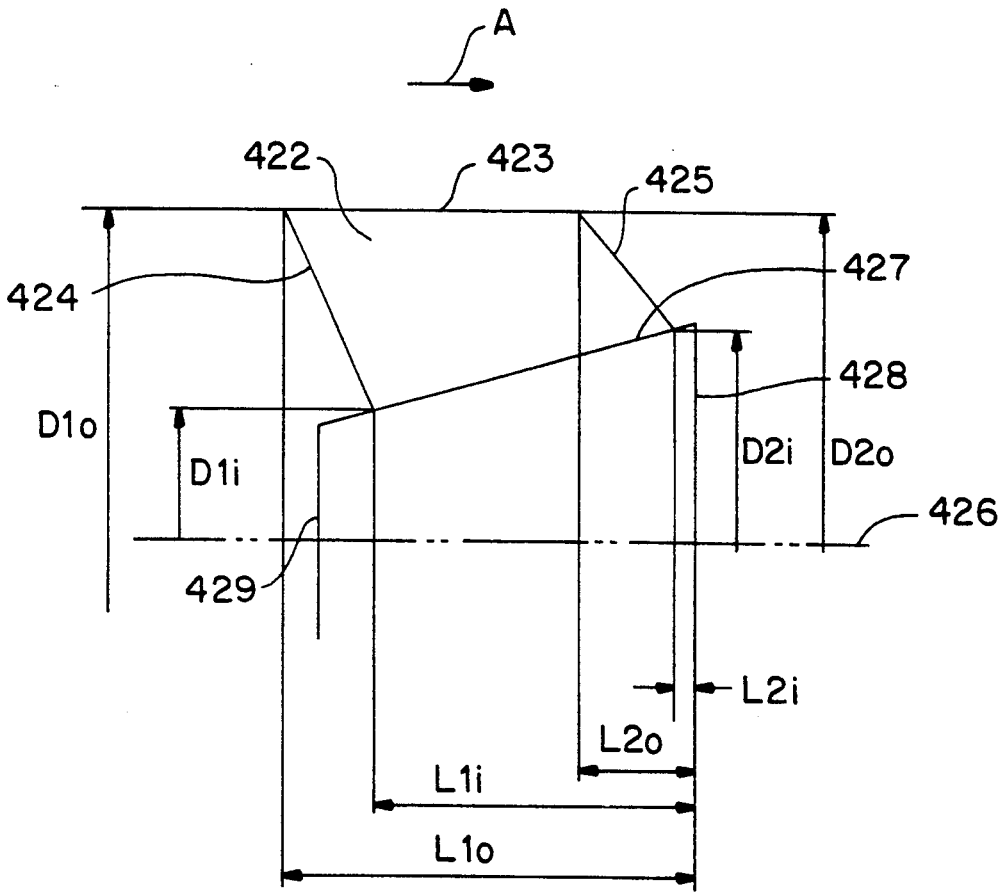
FIG. 3 is a diagram illustrating the unique shape of an impeller constructed in accordance with the principles of the preferred embodiment of the invention.

As shown in FIG. 3, trailing edge 425 of fin unit 422 intersects with outer surface 427 of boss unit 421 a distance $L_{2i}$ from the trailing surface 428 of the boss unit. Leading edge 424 intersects outer surface 427 a distance $L_{1i}$ from trailing surface 428 of boss unit 421. $L_{2o}$ and $L_{1o}$ are components, taken parallel to axis 421, of distances from trailing surface 427 to respective intersections of edges 424 and 425 with outer edges 423. The outer edges 423 of the fin unit are roughly parallel to the axial center 426 of the boss, and the leading edges 424 and trailing edges 425 of the fins both slope, from the outside in, towards the downstream side of the impeller.

As a result of the conical shape of the boss unit, as described above, a diameter $D_{2i}$ of the boss unit at the trailing edge of the fin unit is greater than a diameter $D_{1i}$ of the boss unit at the intersection of surface 427 with leading edge 424, which is near leading surface 429. The outer diameter $D_{1o}$ and $D_{2o}$ of the fin unit at the leading and trailing edges are approximately equal. It will be appreciated that although edges 424 and 425 are depicted as non-parallel, they could also be parallel.

As is also shown in FIG. 3, in accordance with the principles of the preferred embodiment, fin unit 422 of impeller 42 preferably satisfies the conditions $L_{1o}>L_{1i}$, $L_{2o}>L_{2i}$, $D_{1o}=D_{2o}$, and $D_{1i}<D_{2i}$, resulting in the above described structure in which the outer edges 423 of the fins are roughly parallel to the axis of rotation 426 of boss unit 421.

Figure 4:
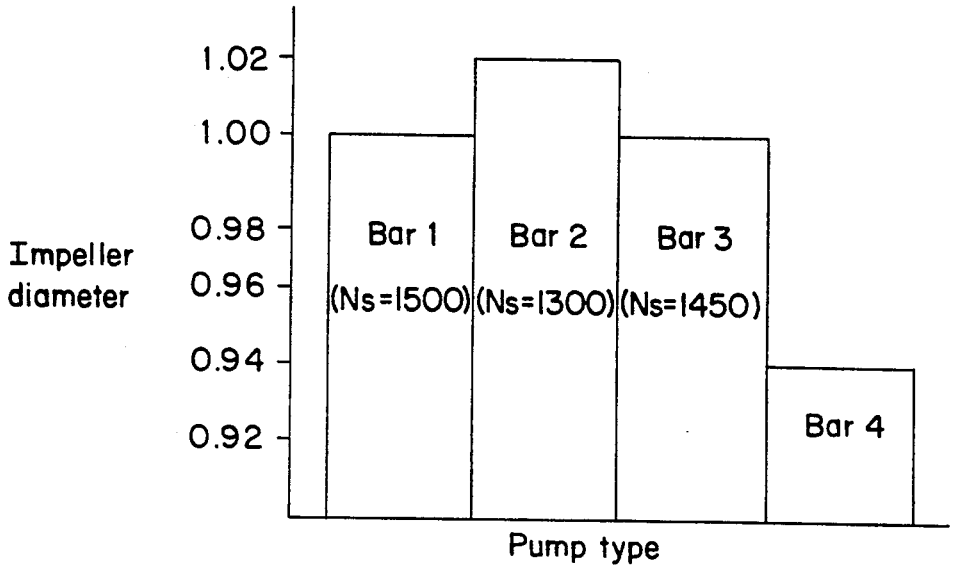
FIG. 4 is a graph comparing the impeller diameters necessary to achieve comparable performance at a relative speed of about 1400 for the preferred and conventional impeller structures.
Figure 6A:
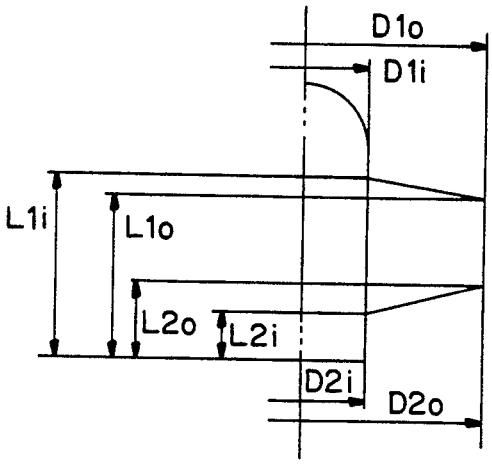
FIG. 6a PRIOR ART
FIG. 6(*a*) is a diagram illustrating a prior art impeller shape.
Figure 6B:
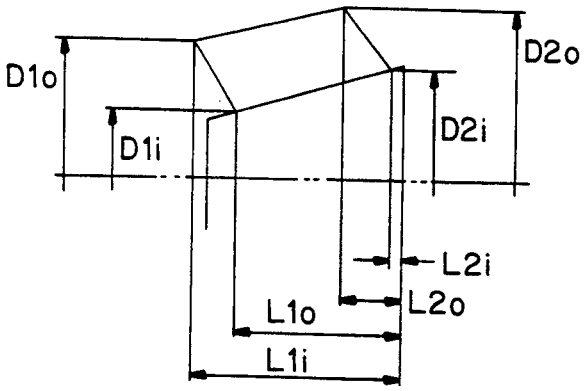
FIG. 6b PRIOR ART
Figure 6C:
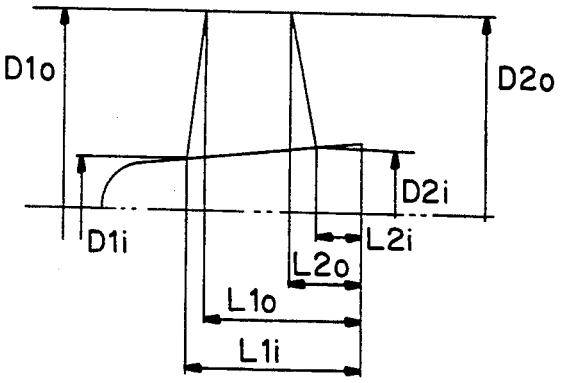
FIG. 6c PRIOR ART

FIG. 4 is a graph comparing impeller diameters necessary to achieve comparable performance between the preferred and prior examples when operating at a speed of about 1400 RPM. In the graphs, the preferred impeller used as an example to represent the invention requires less than half the diameter of the prior art impellers in order to achieve comparable results. In prior art example 1 (see FIG. 6(*a*)), the fins are configured in an axial flow arrangement wherein $L_{1o}<L_{1i}$, $L_{2o}>L_{2i}$, $D_{1o}=D_{2o}$, and $D_{1i}=D_{2i}$. In prior art example 2 (see FIG. 6(*b*)), a mixed flow method is used and the fin configuration is $L_{1o}>L_{1i}$, $L_{2o}>L_{2i}$, $D_{1o}<D_{2o}$, and $D_{1i}<D_{2i}$. In prior art example 3 (see FIG. 6(*c*)), an axial flow method is used, i.e., the leading and trailing edges slant in opposite directions, and $L_{1o}<L_{1i}$, $L_{2o}>L_{2i}$, $D_{1o}=D_{2o}$, and $D_{1i}<D_{2i}$.

Prior art example 2 is similar to the preferred example in its use of a mixed flow method, but differs in that $D_{1o}$ does not equal $D_{2o}$. Example 3 differs in that the edges of the fins slant in opposite directions such that $L_{1o}<L_{1i}$, rather than the preferred $L_{1o}>L_{1i}$.

Figure 5:
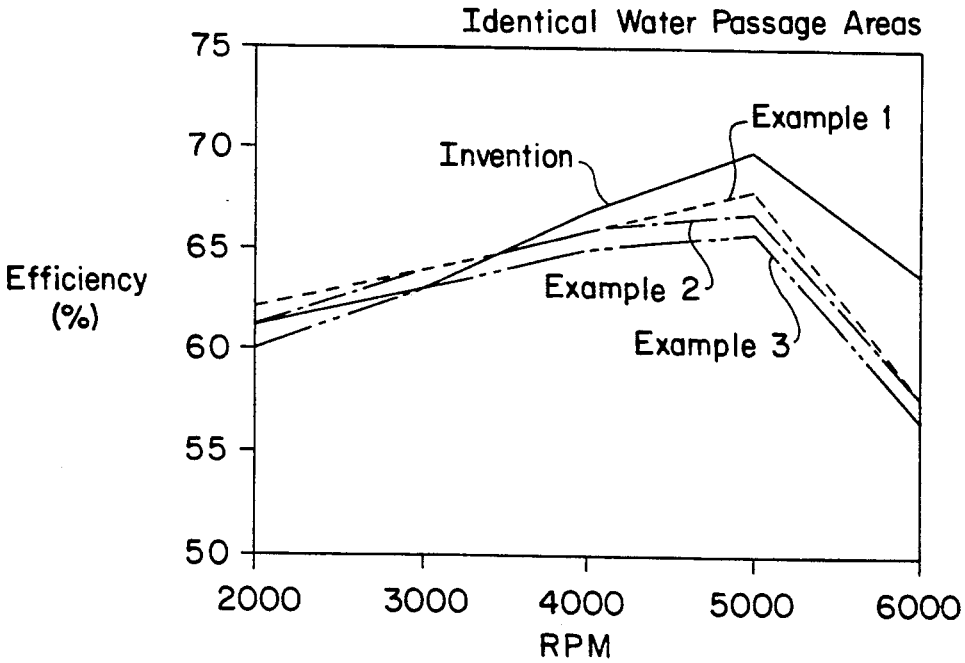
FIG. 5 is a graph showing the relationship between rpm and efficiency for the preferred and conventional impeller structures when used in connection with water passages having the same area.

FIG. 5 shows the relationship between the number of revolutions per minute and efficiency of the inventive system and the three prior art systems for the same water passage area. According to this graph, the invention provides higher efficiency than the prior art examples at impeller speeds of 3,500 RPMs and above.

In summary, the invention provides a water jet propelled boat equipped with a mixed flow type of impeller 42 and a water intake opening and water jet outlet The water intake opening and water jet outlet are connected by a water passage 51, and the impeller 42 is mounted midway inside it. The action of the impeller causes water to be drawn in through the intake and expelled through the outlet to propel the boat, the impeller itself having the following unique features:

the boss section 421 making up the impeller has a plurality at fins 422 affixed to it;

the outside edges 423 of the fins 422 are substantially parallel to the axial center of the boss 421;

relative to the axial center of the boss 421, starting from the outside edges of the fins 422, the leading edges 424 and the trailing edges 425 of the spiral fins slant toward the water outlet opening.

As a result, as shown in FIG. 4, at roughly the same speeds, the diameter of the fin unit can be smaller than that used in impellers of the prior art, and as FIG. 5 shows, at speeds of 4,000 rpm and over, the efficiency (%) is greater than that provided in the prior art.

It will of course be appreciated that the above description is to be understood as being exemplary and not limiting in nature, and that variations of the preferred structure may occur to those skilled in the art which are within the spirit and scope of the invention. Therefore, it is intended that the invention be defined solely in accordance with the appended claims.

We claim:

1. An impeller structure for a water jet propelled boat of the type having a water intake opening and a water jet outlet connected by a water passage, comprising:

boss means for mounting an impeller in said water passage in order to cause water to be drawn in through the intake and expelled through the outlet to propel the boat when the impeller is rotated around an axis of said boss means;

a fin mounted on the boss means and having a leading edge on an upstream side of said fin relative to a direction of water flow in said water passage, a trailing edge on a downstream side of said fin relative to the direction of water flow, and an outside edge connecting said leading and trailing edges, wherein said outside edge is substantially parallel to said axis of the boss means, and the leading and trailing edges both slope, from said outside edge to said boss means, towards a downstream side of the boss means relative to the direction of water flow, and wherein said leading and trailing edges are mutually non-parallel.

2. An impeller structure as claimed in claim 1, wherein said boss means includes a trailing surface on a downstream side of said boss means an outside surface to which said fin is attached, wherein a distance $L_{2i}$ from said trailing surface to an intersection between said trailing edge and said outside surface is less than a component $L_{2o}$ of a distance between said trailing surface and an intersection between said trailing edge and said outside edge taken parallel to said axis, and wherein a distance between said trailing surface and an intersection between said leading edge and said outside surface $L_{1i}$ is less than a component $L_{1o}$, taken parallel to said axis, of a distance between said trailing surface and an intersection between said leading edge and said outside edge.

3. An impeller structure as claimed in claim 2, wherein a diameter $D_{2i}$ of said boss means at said trailing surface is greater than a diameter $D_{1i}$ of said boss means at a leading surface on an upstream side of said boss means.

4. An impeller structure as claimed in claim 1, wherein a diameter $D_{2i}$ of a trailing surface of said boss means on the downstream side of said boss means is greater than a diameter $D_{1i}$ of a leading surface of said boss means located on an upstream side of said boss means.

5. An impeller structure as claimed in claim 1, wherein said boss means has a frusto-conical shape, and wherein an upstream side of said boss means has a smaller area than the downstream side of said boss means.

* * * * *